US011849276B2

(12) United States Patent
Franzén

(10) Patent No.: US 11,849,276 B2
(45) Date of Patent: Dec. 19, 2023

(54) THROAT HEADSET SYSTEM

(71) Applicant: Patent Holding i Nybro AB, Nybro (SE)

(72) Inventor: Bo Franzén, Nybro (SE)

(73) Assignee: PATENT HOLDING I NYBRO AB, Nybro (SE)

( * ) Notice: Subject to any disclaimer, the term of this patent is extended or adjusted under 35 U.S.C. 154(b) by 132 days.

(21) Appl. No.: 17/162,653

(22) Filed: Jan. 29, 2021

(65) Prior Publication Data

US 2021/0250679 A1 Aug. 12, 2021

(30) Foreign Application Priority Data

Feb. 12, 2020 (EP) ..... 20156821

(51) Int. Cl.
*H04R 1/10* (2006.01)
*H04R 1/14* (2006.01)
*H04R 17/02* (2006.01)

(52) U.S. Cl.
CPC ..... *H04R 1/14* (2013.01); *H04R 1/1016* (2013.01); *H04R 1/1041* (2013.01); *H04R 1/1083* (2013.01); *H04R 17/02* (2013.01); *H04R 2420/07* (2013.01)

(58) Field of Classification Search
CPC ..... H04R 1/14; H04R 1/1016; H04R 1/1041; H04R 1/1083; H04R 17/02
See application file for complete search history.

(56) References Cited

U.S. PATENT DOCUMENTS 5,631,965 A 5/1997 Chang et al.
9,336,795 B1 * 5/2016 Robertson ..... A61B 5/4803
2006/0239489 A1 * 10/2006 Franzen ..... H04R 5/033 381/375
2007/0165885 A1 * 7/2007 Chou ..... H04R 1/46 381/151
2007/0269073 A1 * 11/2007 Huang ..... H04R 1/1016 381/190
2011/0051944 A1 * 3/2011 Kirkpatrick ..... H04R 1/14 381/70
2012/0197635 A1 * 8/2012 Nystrom ..... H04R 3/005 704/201

(Continued)

FOREIGN PATENT DOCUMENTS

CH 681 841 A5 5/1993
CN 105476152 A 4/2016

(Continued)

*Primary Examiner* — Simon King
(74) *Attorney, Agent, or Firm* — Birch, Stewart, Kolasch & Birch, LLP

(57) ABSTRACT

A throat headset system includes an element configured to be arranged at least partially around a user's neck, at least one microphone being connected to the element and configured to be in contact with a user's throat or neck skin when the headset is worn and connected wireless or by cable to the microphone and configured to be connected to a communication device, in a wireless manner or via a cable, and at least one earphone connected to the cable or in a wireless manner to a communication unit. The microphone is a microphone of the type that does not require power or electric energy of a power source for detecting sound waves.

11 Claims, 2 Drawing Sheets

(56) References Cited

U.S. PATENT DOCUMENTS

| | | | | |
|---|---|---|---|---|
| 2012/0243699 | A1* | 9/2012 | Michael | A61B 1/227 381/72 |
| 2013/0256345 | A1* | 10/2013 | Larkin | H04R 1/105 224/201 |
| 2016/0277824 | A1* | 9/2016 | Ushakov | H04R 1/1033 |
| 2016/0302003 | A1* | 10/2016 | Rahman | H04R 1/2876 |
| 2018/0068103 | A1* | 3/2018 | Pitkänen | G06Q 20/40145 |
| 2019/0253809 | A1* | 8/2019 | Kunimoto | H04R 1/1041 |
| 2019/0313196 | A1* | 10/2019 | Usher | H04R 25/70 |
| 2020/0128317 | A1* | 4/2020 | Feldman | H04R 1/04 |
| 2021/0176552 | A1* | 6/2021 | Kunimoto | H01R 13/70 |
| 2021/0211794 | A1* | 7/2021 | Cho | H04R 1/083 |
| 2021/0297789 | A1* | 9/2021 | De Haan | H04R 25/604 |

FOREIGN PATENT DOCUMENTS

| | | | |
|---|---|---|---|
| SE | 525 392 | C2 | 2/2005 |
| WO | WO 2008/002266 | A1 | 1/2008 |

* cited by examiner

THROAT HEADSET SYSTEM

FIELD OF INVENTION

The present invention generally relates to the field of headset systems, in particular throat headset systems configured to be at least partially worn around a user's neck with one or several microphone(s) being configured to be in contact with at least a part of the user's throat in combination with at least one in-ear speaker.

BACKGROUND OF THE INVENTION

So called throat microphones or throat headset systems were introduced earlier and are for instance discussed and shown in SE 525392. In this document a particular attenuation function is discussed. The SE 525392 further discloses to use condenser microphones/capacitor microphones, such as for example electret microphones. Such microphones, which are positioned at the throat of the user when the headset system is in use, comprise a thin metal plate and a plastic foil typically covered with a metal that is vaporized on it. The plastic foil and the thin metal plate are typically arranged parallel as a capacitor with a minus and plus load while the plastic foil is exposed to waves, typically sound waves, and generates a change in the capacity, which allows to generate a signal so that sound can be detected and a voice of a user can be detected.

Capacitor microphones or electret microphones require a certain amount of external power or energy so that they can function, which is typically due to transistors built into them. This power is drawn from the phantom voltage of a mobile phone or other communication device. Typically a capacitor microphone or electret microphone requires a voltage output of about 1.5 V at the microphone exit of the mobile phone or communication device.

In particular with throat microphones it can be a problem when the throat microphone requires power or electric energy in order to function, since for example mobile phones have a much lower power output at the jack where the microphone is connected. Another disadvantage is that the phantom voltage is reduced by the electret or condenser microphone, which leads to distortions in the capacitor microphone itself. In other solutions where the headset system is for instance a Bluetooth headset a conventional capacitor microphone draws power from a battery thereby shortening battery life. As mentioned, even so called electret microphones, which comprise a ferromagnetic thin metal plate and a plastic foil with a ferromagnetic metal vaporized on it, draw energy from the communication equipment, since electret microphones typically comprise an integrated preamplifier that requires power, which is normally phantom voltage provided by a communication device such as for example a smart phone.

SUMMARY OF THE INVENTION

An object of the present invention is to provide a throat headset system that comprises a microphone that functions without or with as little external power as possible.

Another object is to provide a headset system that is reliable and accurate.

The inventor of the present disclosure has discovered that it is possible to use a different type of microphone when constructing and designing throat headsets, throat microphones or throat headset systems. The desire for avoiding traditionally used electret or capacitor microphones originates from the problem that electret or capacitor microphones require electric power or energy to function and this can lead to distortions in the actual microphone. The different type of microphones may be magnetic microphones, dynamic microphones or piezoelectric microphones, which type of microphones do not require an external power source. Surprisingly nobody else ever thought of that before and dynamic, magnetic or piezoelectric microphones have never been used before in throat microphone systems comprising one or several throat microphones in combination with one or more in-ear speakers or loudspeakers.

Magnetic microphones, dynamic microphones or piezoelectric microphones have the advantage that they function without external energy or power, so they do not draw from the phantom voltage of the communication device and the microphone does therefore not generate any distortion because of draining the power to be low voltage.

Disclosed herein is headset system comprising an element configured to be arranged at least partially around a user's neck, at least one microphone being connected to the element and configured to be in contact with a user's throat or neck or neck skin when the headset is worn, a communication unit connected to the microphone and connectable to a communication device, for example a two-way radio, or a mobile phone and at least one earphone connected to the communication unit. Alternatively the at least one earphone may be connected to the cable via an electric circuit connected to the cable. The microphone may be a microphone of the type that does not require power, in particular electric energy, of a power source for detecting vibrations of sound.

The advantage of the described headset system is that it does not draw power from a mobile phone, smart phone or another communication equipment but is entirely self-sufficient.

The term throat or neck skin is to be read that it is not needed to have the microphone to pick up the users voice directly from the Larynx/Voicebox, it is possible to use the entire neck skin (and throat skin) as pick up area of sound for the microphone.

In an embodiment the microphone of the type that does not require power/voltage, in particular electric energy, or a power source for detecting vibrations of sound may be a dynamic microphone, a piezoelectric microphone or a magnetic microphone.

The described microphone types are suitable for an application as throat microphones, in particular the piezoelectric microphone may be suitable for application as throat microphone, since it does not draw any power or energy from the communication equipment and due to its rather efficient construction.

In a further embodiment the headset system may comprise an electric circuit and the at least one earphone may be a soundproof earphone and comprise a sound attenuator and a microphone. The microphone may be arranged on a side oriented away from a sound channel of the at least one earphone and being connected to the electric circuit.

The soundproof characteristic may be achieved via correspondingly formed soft parts of the earphone, soft parts that tighten around the auditory canal of the ear so that less ambient sound can enter the ear.

Using a microphone and an attenuator for the at least one earphone of the headset system allows to control which noise and what noise level or volume can pass through the earphone and enter the auditory canal of the user.

In an embodiment the at least one earphone may be configured to connect to the electric circuit or the communication device in a wireless manner.

In a further embodiment the at least one earphone may comprise an ear loud speaker with connection means for connection to a detachable ear unit adapted to be inserted into the auditory canal of the ear for soundproof abutment against the auditory canal when the at least one earphone is worn by a user.

In this embodiment the soundproof characteristic may be achieved by using a correspondingly designed ear unit.

In an embodiment the sound attenuator may be a passive sound attenuator.

In another embodiment the sound attenuator may be an active sound attenuator adapted for attenuation of sound above a certain sound level and without attenuation to let sound below this sound level to pass through.

The headset system as described may further comprise two earphones one for each ear of the user. Each of the earphones may comprise a sound attenuator or microphone of any of the types described above.

In an embodiment the entire headset can be connected to a communication device either by wires or in a wireless manner.

Alternatively, wires may extend from the ear speakers or ear loudspeakers, which ear loudspeakers may or may not comprise attenuation microphones, for interconnecting at least one wiring of the neck microphone. The neck microphone may then be connected to a communication device wirelessly or via a wire.

In alternative embodiment the ear loudspeakers may be connected to the neck microphone in a wireless manner and then further to a communication device via a wire or wireless.

In another embodiment it may also be possible to interconnect the ear loudspeakers directly to the communication device and the neck microphone as well, independent from one another. These connections may be via wires or preferably wireless.

BRIEF DESCRIPTION OF THE DRAWINGS

The present invention will now be described, for exemplary purposes, in more detail by way of an embodiment and with reference to the enclosed drawings, in which.

DETAILED DESCRIPTION

Figure 1:
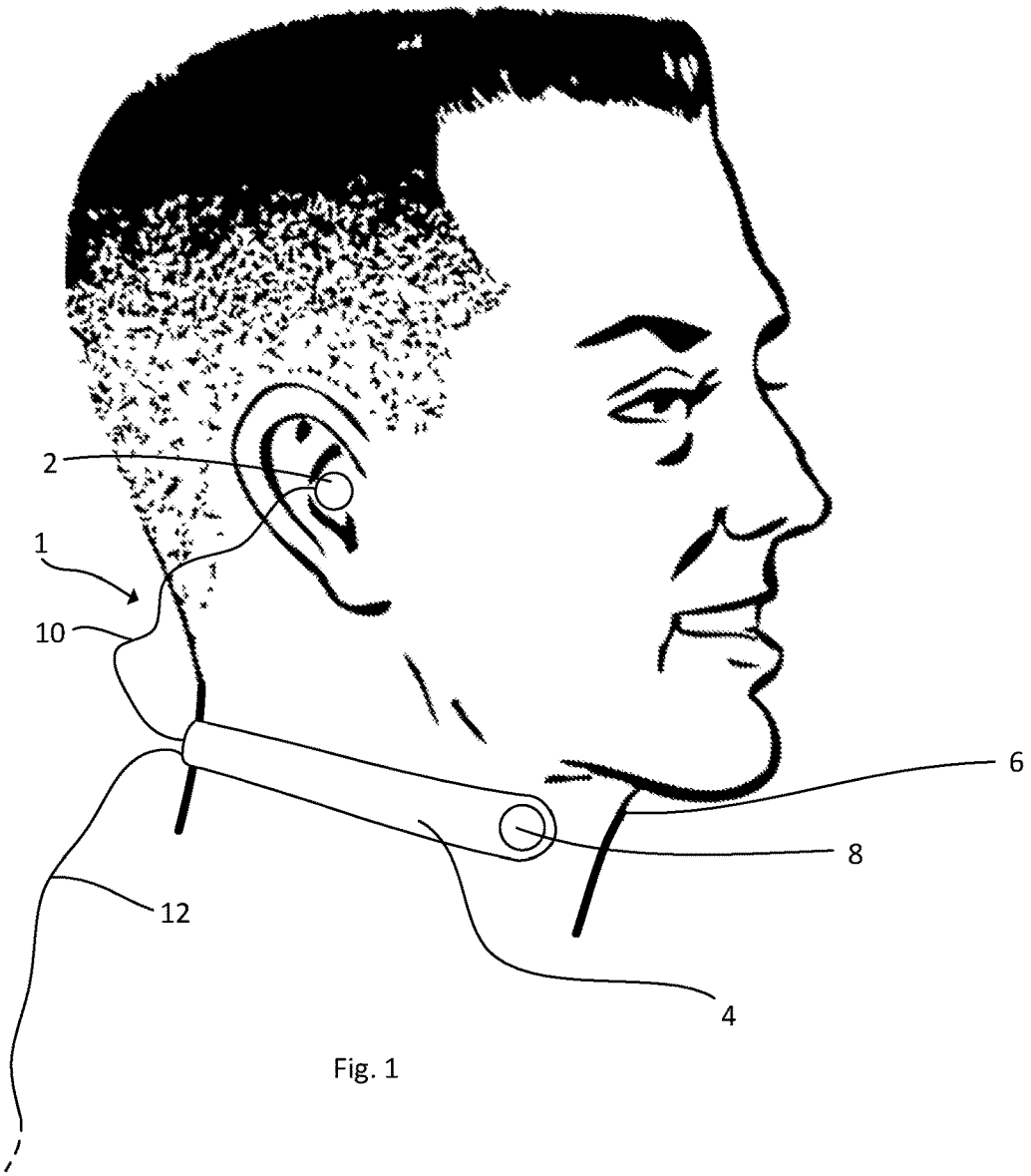
FIG. 1 schematically illustrates a user wearing a throat headset system according to an embodiment of the invention.

FIG. 1 illustrates a throat headset system 1 comprising at least one earphone 2, an element 4 configured to be arranged, at least partially, around a user's 6 neck. The element 4 may comprise at least one microphone 8 being configured to be in contact with at least a part of the user's throat or neck skin and being integrally formed with the element 4. The at least one earphone 2 is connected to the element 4 via a cable 10. The headset system 1 may be connected to a communication device such as a communication radio, a mobile phone, etc. (not shown) via another cable 12. These cables 10, 12 may be replaced by a wireless communication solution such as Bluetooth or the like.

The element 4 arranged around the user's 6 neck may be a neckband similar to a conventional headband of a headset, or even a flexible band or the like. The neckband may be bow-shaped so that it extends at least partially around the user's 6 throat. The microphone 8 may be integrated in the neckband or band or arranged on top or bottom on the inside of it. Integration may be favorable for user comfort. If a neckband is used as element 4 it may be made of elastic plastic or the like so that it can easily be fitted around the neck of a user 6. If a band or the like is used it may be made of an elastic material or an elastic fabric. Typically the microphone 8 used as throat microphone 8 is a capacitor microphone. The concept of a capacitor or electret microphone is shown and explained referring to FIG. 2. As previously described herein capacitor microphones or electret microphones are not suitable for use as throat microphones since they draw too much energy from the communication equipment and the phantom voltage thereof, respectively. The functionality of a capacitor microphone is herein however explained for understanding purposes.

Figure 3:
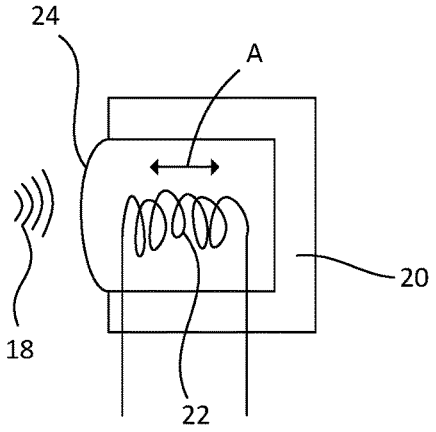
FIG. 3 schematically illustrates the concept of a dynamic microphone.
Figure 4:
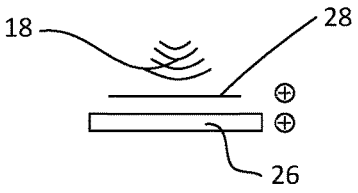
FIG. 4 schematically illustrates the concept of a magnetic microphone.
Figure 5:
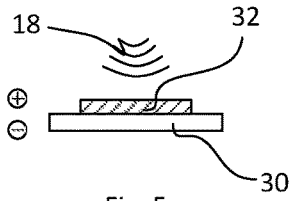
FIG. 5 schematically illustrates the concept of a piezoelectric microphone.

FIGS. 3 to 5 illustrate the concept of a dynamic microphone (FIG. 3), a magnetic microphone (FIG. 4) and a piezoelectric microphone (FIG. 5).

Figure 2:
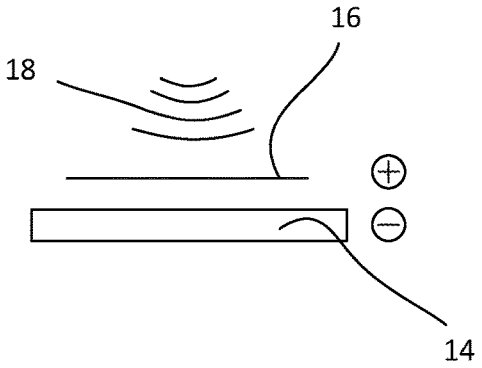
FIG. 2 schematically illustrates the concept of a capacitor microphone.

Referring now to FIG. 2, the concept of a capacitor microphone is herewith briefly explained. A capacitor microphone comprises a thin metal plate 14 and a plastic foil 16 with a metal vaporized on it. The thin metal plate 14 and the plastic foil 16 form a capacitor with a certain capacitance. The sound waves 18 will hit the plastic foil 16 that then starts to move and therewith changes the capacitance of the capacitor formed by the thin metal plate 14 and the plastic foil 16. This change in capacitance can then be detected and a signal can be generated therefrom. The capacitor needs however to have an electrical circuit with typically a transistor that needs a certain electric energy supply so that it can work properly. This energy supply is typically drawn from the phantom voltage of a communication device, such as a communication radio or a smart phone. This can lead to distortions in the microphone and in some cases the communication device is not even configured to provide any phantom voltage, which poses problems to the microphone and the quality of the generated signal may decrease therewith.

FIG. 3 illustrates the concept of a dynamic microphone comprising a magnet 20 in the form of a magnetic yoke and a winding 22. The winding 22 is positioned so that it can easily move in the direction of the arrow A in FIG. 3. The sound waves 18 will hit a membrane 24, that is for instance made of a plastic material or the like, which membrane 24 will then start to move and thereby move the winding 22 in the direction of the arrow A. The movement of the winding 22 in the magnet 20 will generate a voltage in the winding 22 so that a signal can be generated that represents the sound waves 18. The advantage of the dynamic microphone concept is that it does not require an external power source for functioning.

FIG. 4 illustrates the concept of a magnetic microphone, which is very similar to the one of a capacitor microphone as shown in FIG. 2, with the difference that the magnetic microphone will not need an external power source. The magnetic microphone comprises a thin metal plate 26 and a metal foil or plate 28. The metals of the thin metal plate 26 and the metal foil 28 may be ferromagnetic metals, which are magnetically preloaded so that both the metal foil 28 and the thin metal plate 26 are both magnetically charged. A movement of the metal foil 26 due to sound waves 18 may then generate a voltage between the metal foil 28 and the thin metal plate 26, which can be sensed and changed into a signal that represents the sound waves 18. Due to the magnetic preloading no external power is needed for these kinds of microphones.

FIG. 5 illustrates a piezoelectric microphone comprising a thin metal plate 30 and a piezo crystal layer 32 arranged on top of it. The characteristic of the piezo crystal layer 32 is that it changes voltage when it is deformed or under mechanical stress. When the sound waves 18 hit the piezo crystal layer 32 a deformation or at least mechanical stress will happen and the piezo crystal layer 32 generates a voltage, which again generates a signal that can be used to interpret the sound waves 18.

Using at least one piezo electric microphone in the headset system 1 according to the invention may be in particular beneficial, due to its simplicity in construction and also since it does not draw any power in order to function. When using at least one piezoelectric microphone there are no distortions in the microphone as a lack of power.

Figure 6:
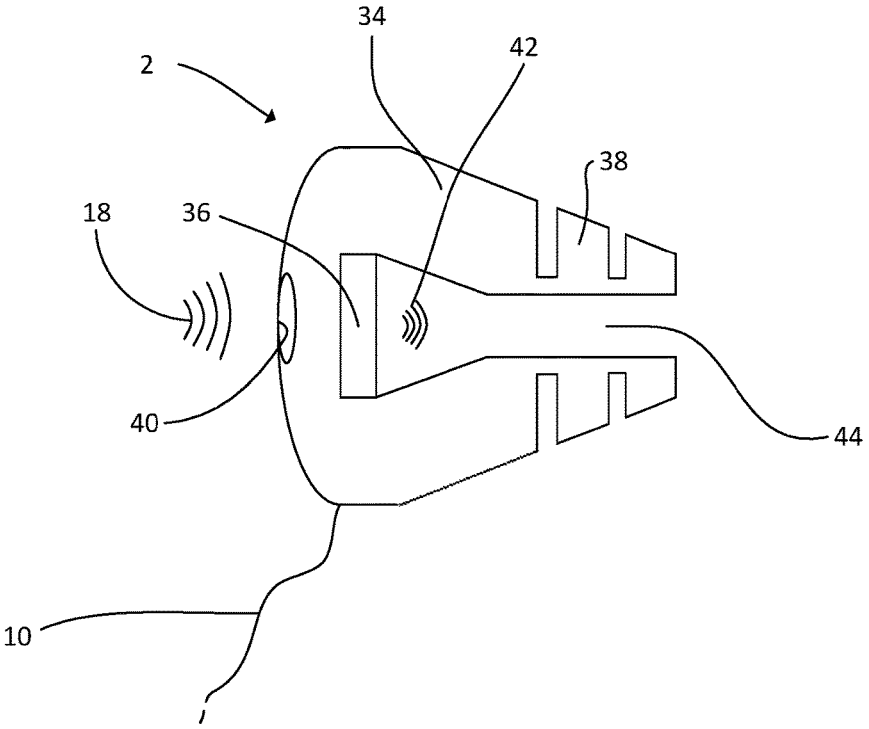
FIG. 6 schematically illustrates a cross sectional view through an earphone of a throat headset system according to the invention.

FIG. 6 illustrates a cross sectional view onto an earphone 2 that can be used in throat headset system. The earphone 2 may comprise some sort of a casing or housing 34. In the housing 34 an ear loudspeaker 36 may be arranged that can generate soundwaves 42. The sound waves 42 may travel through the sound channel 44 of the housing 34. In order to soundproof an ear of a user, when the earphone 2 is worn, the housing 34 may comprise soft parts 38 extending away from the sound channel 44. The soft parts 38 may tighten and soundproof between the auditory canal of the ear of a user and the earphone 2.

The earphone 2 may comprise a microphone 40, for instance an attenuation microphone, itself. The attenuation microphone 40 may be arranged together with a sound attenuator (not shown) that decides which external noise is to pass and which not or which level of external noise should go past the earphone and into the sound channel 44 of the earphone 2. The soft parts can be arranged as replaceable types or parts both for hygienic reasons and also due different sizes of ear channels of different users. The microphone 40 and the sound attenuator may be configured to protect the ear of the user by filtering out very loud noises or at least reduce their volume. The ear loudspeaker 36, the microphone 40 and the sound attenuator may be electrically connected with each other and they may be connected to the element 4 (FIG. 1) via a cable 10, which is illustrated in FIG. 6. The attenuation microphone 40 may be arranged on the earphone 2 or on the cable leading to the earphone 2 (not shown). This may be advantageous if the earphone is used under a helmet for example.

The earphone 2 may further comprise an electric circuit (not shown) that is connected to the ear loudspeaker 36, microphone 40, the sound attenuator and the cable 10.

The circuit for regulation of the wanted attenuation may be positioned inside the ear loudspeaker housing, in the wire system, in the neckband, in a separate box, or in the connected communication device, such as a mobile phone or communication radio.

Alternatively to the cable 10, the earphone 2 may be connected to the element 4 and the microphone 8, respectively, via a wireless solution, such as Bluetooth or Wifi protocol.

In an embodiment (not shown) the ear loud speaker can be configured to be detachable from the housing for instance via connection means or the like.

Further the housing may comprise differently shaped soft parts 38 than the ones illustrated in FIG. 6. In particular they may be improved or changed in order to improve soundproofing between the auditory canal of the ear and the earphone and the soft parts, respectively.

The invention claimed is:

1. A throat headset system for use in noisy environments comprising:

an element configured to be arranged at least partially around a neck of a user;

at least one microphone being connected to the element, the element being configured to press the at least one microphone into direct abutment with neck skin or throat skin of the user when the throat headset system is worn to pick up sound from said neck skin or throat skin, the at least one microphone not requiring power, voltage or electric energy of a power source for detecting sound waves;

a communication unit arranged at the element and connected to the at least one microphone and connectable to a communication device;

at least one in-ear earphone connected to the communication unit; and an electric circuit, wherein the at least one in-ear earphone is a soundproof in-ear earphone comprising formed soft parts, a sound attenuator and an ambient hearing microphone, wherein soundproofing is achieved via the soft parts of the soundproof earphone by the soft parts being configured to tighten around an auditory canal of the user so that less ambient sound can enter the ear when the soundproof in-ear earphone is worn by the user, the ambient hearing microphone being arranged on a side oriented away from a sound channel of the at least one in-ear earphone and being connected to the electric circuit, and wherein the sound attenuator is an active sound attenuator configured to attenuate sound picked up by the ambient hearing microphone being above a certain sound level.

2. The throat headset system of claim 1, wherein the at least one microphone of the type that does not require power, voltage or a power source for detecting sound waves is a dynamic microphone, a piezoelectric microphone or a magnetic microphone.

3. The throat headset system of claim 2, wherein the at least one microphone is a piezoelectric microphone comprising a thin metal sheet and a piezo crystal layer arranged on top of the thin metal sheet.

4. The throat headset system according to claim 1, wherein the at least one in-ear earphone is configured to be connected in a wireless manner to the electric circuit.

5. The throat headset system according to claim 1, wherein the active sound attenuator is configured to let sound below said sound level pass through without attenuation.

6. The throat headset system according to claim 1, comprising two in-ear earphones, one for each ear of a user.

7. The throat headset system according to claim 1, wherein the element is a neckband at least partially shaped as a bow and made of an elastic plastic or metal.

8. The throat headset system according to claim 1, wherein the element is a band that is configured to go around the neck of the user when the throat headset system is worn.

9. The throat headset system according to claim 1, wherein the formed soft parts are replaceable.

10. A throat headset system for use in noisy environments comprising:

an element configured to be arranged at least partially around a neck of a user;

at least one microphone being embedded in the element and configured to be in contact with neck skin or throat skin of the user when the throat headset system is worn to pick up sound from said neck skin or throat skin, the at least one microphone not requiring power, voltage or electric energy of a power source for detecting sound waves;

a communication unit arranged at the element and connected to the at least one microphone and connectable to a communication device;

at least one in-ear earphone connected to the communication unit; and an electric circuit, wherein the at least one in-ear earphone is a soundproof in-ear earphone and comprises formed soft parts, a sound attenuator and an ambient hearing microphone, wherein soundproofing is achieved via the soft parts of the soundproof earphone by the soft parts being configured to tighten around an auditory canal of the user so that less ambient sound can enter the ear when the soundproof in-ear earphone is worn by the user, the ambient hearing microphone being arranged on a side oriented away from a sound channel of the at least one in-ear earphone and being connected to the electric circuit, wherein the sound attenuator is an active sound attenuator configured to attenuate sound picked up by the ambient hearing microphone being above a certain sound level.

11. A throat headset system for use in noisy environments comprising:

an element configured to be arranged at least partially around a neck of a user;

at least one microphone connected to the element so as to be fixed relative to the element and configured to be in contact with neck skin or throat skin of the user when the throat headset system is worn to pick up sound from said neck skin or throat skin, the at least one microphone not requiring power, voltage or electric energy of a power source for detecting sound waves;

a communication unit arranged at the element and connected to the at least one microphone and connectable to a communication device;

at least one in-ear earphone connected to the communication unit; and an electric circuit, wherein the at least one in-ear earphone is a soundproof in-ear earphone and comprises formed soft parts, a sound attenuator and an ambient hearing microphone, wherein soundproofing is achieved via the soft parts of the soundproof earphone by the soft parts being configured to tighten around an auditory canal of the user so that less ambient sound can enter the ear when the soundproof in-ear earphone is worn by the user, the ambient hearing microphone being arranged on a side oriented away from a sound channel of the at least one in-ear earphone and being connected to the electric circuit, and wherein the sound attenuator is an active sound attenuator configured to attenuate sound picked up by the ambient hearing microphone being above a certain sound level.

* * * * *